US005827334A

United States Patent [19]

Cherpeck

[11] Patent Number: 5,827,334

[45] Date of Patent: Oct. 27, 1998

[54] SUBSTITUTED BIPHENYL POLYALKYL ESTERS AND FUEL COMPOSITIONS CONTAINING THE SAME

[75] Inventor: Richard E. Cherpeck, Cotati, Calif.

[73] Assignee: Chevron Chemical Company LLC, San Francisco, Calif.

[21] Appl. No.: 940,846

[22] Filed: Sep. 30, 1997

[51] Int. Cl.[6] ..... C10L 1/18; C10L 1/22; C07C 229/00

[52] U.S. Cl. ..... 44/388; 44/399; 44/400; 560/48

[58] Field of Search ..... 44/388, 399, 400; 560/48

[56] References Cited

U.S. PATENT DOCUMENTS

| | | | |
|---|---|---|---|
| 3,285,855 | 11/1966 | Dexter et al. | 252/57 |
| 4,859,210 | 8/1989 | Franz et al. | 44/53 |
| 5,196,142 | 3/1993 | Mollet et al. | 252/311 |
| 5,196,565 | 3/1993 | Ross | 560/55 |
| 5,380,345 | 1/1995 | Cherpeck | 44/399 |
| 5,540,743 | 7/1996 | Cherpeck | 44/399 |

*Primary Examiner*—Gary Geist
*Assistant Examiner*—Brian J. Davis
*Attorney, Agent, or Firm*—Claude J. Caroli

[57] ABSTRACT

Substituted biphenyl polyalkyl esters having the formula:

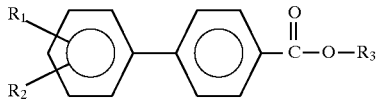

wherein $R_1$ is hydrogen or hydroxyl; $R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

The substituted biphenyl polyalkyl esters of the present invention are useful as fuel additives for the prevention and control of engine deposits.

29 Claims, No Drawings

SUBSTITUTED BIPHENYL POLYALKYL ESTERS AND FUEL COMPOSITIONS CONTAINING THE SAME

BACKGROUND OF THE INVENTION

1. Field of the Invention

This invention relates to substituted biphenyl polyalkyl esters and to fuel compositions containing substituted biphenyl polyalkyl esters to prevent and control engine deposits.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

U.S. Pat. No. 3,285,855, issued Nov. 15, 1966 to Dexter et al., discloses alkyl esters of dialkyl hydroxybenzoic and hydroxyphenylalkanoic acids wherein the ester moiety contains from 6 to 30 carbon atoms. This patent teaches that such esters are useful for stabilizing polypropylene and other organic material normally subject to oxidative deterioration. Similar alkyl esters containing hindered dialkyl hydroxyphenyl groups are disclosed in U.S. Pat. No. 5,196,565, which issued Mar. 23, 1993 to Ross.

U.S. Pat. No. 4,859,210, issued Aug. 22, 1989 to Franz et al., discloses fuel compositions containing (1) one or more polybutyl or polyisobutyl alcohols wherein the polybutyl or polyisobutyl group has a number average molecular weight of 324 to 3,000, or (2) a poly(alkoxylate) of the polybutyl or polyisobutyl alcohol, or (3) a carboxylate ester of the polybutyl or polyisobutyl alcohol. This patent further teaches that when the fuel composition contains an ester of a polybutyl or polyisobutyl alcohol, the ester-forming acid group may be derived from saturated or unsaturated, aliphatic or aromatic, acyclic or cyclic mono- or polycarboxylic acids.

U.S. Pat. No. 5,196,142, issued Mar. 23, 1993 to Mollet et al., discloses alkyl esters of hydroxyphenyl carboxylic acids wherein the ester moiety may contain up to 23 carbon atoms. This patent teaches that such compounds are useful as antioxidants for stabilizing emulsion-polymerized polymers.

U.S. Pat. No. 5,380,345, issued Jan. 10, 1995 to Cherpeck, discloses polyalkyl nitro and amino aromatic esters that provide excellent control of engine deposits, especially intake valve deposits, when employed as fuel additives in fuel compositions.

U.S. Pat. No. 5,540,743, issued Jul. 30, 1996 to Cherpeck, relates to polyalkyl and poly(oxyalkylene)benzyl amine esters and to fuel compositions containing the same. More particularly, this patent discloses that certain polyalkyl and poly(oxyalkylene)benzyl amine esters are useful in fuel compositions to prevent and control engine deposits, especially intake valve deposits.

My commonly assigned copending U.S. patent application Ser. No. 08/581,658, filed Dec. 29, 1995, now U.S. Pat. No. 5,637,119, discloses a novel fuel-soluble substituted aromatic polyalkyl ether fuel additive which is useful for the prevention and control of engine deposits, particularly intake valve deposits, when employed as fuel additives in fuel compositions.

More recently, my commonly assigned copending U.S. patent application Ser. No. 08/778,200, filed Dec. 30, 1996, now U.S. Pat. No. 5,728,182, discloses certain polyalkyl esters of substituted polyphenyl ethers are surprisingly useful for reducing engine deposits, especially intake valve deposits, when employed are fuel additives in fuel compositions.

It has now been discovered that certain substituted biphenyl polyalkyl esters are surprisingly useful for reducing engine deposits, especially intake valve deposits, when employed as fuel additives in fuel compositions.

SUMMARY OF THE INVENTION

The present invention provides novel substituted biphenyl polyalkyl ester fuel additives which are useful for the prevention and control of engine deposits, particularly intake valve deposits.

The substituted biphenyl polyalkyl esters of the present invention have the formula:

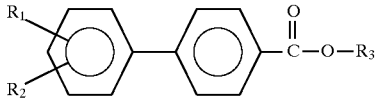

Formula I wherein $R_1$ is hydrogen or hydroxyl; $R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

The present invention further provides a fuel composition comprising a major amount of hydrocarbons boiling in the gasoline or diesel range and an effective deposit-controlling amount of a substituted biphenyl polyalkyl ester of formula I above.

The present invention additionally provides a fuel concentrate comprising an inert stable oleophilic organic solvent boiling in the range of from about 150° F. (65° C.) to about 400° F. (205° C.) and from about 10 to about 70 weight percent of a substituted biphenyl polyalkyl ester formula I above.

The present invention also provides a method for reducing engine deposits in an internal combustion engine comprising operating the engine with a fuel composition containing an effective deposit-controlling amount of a substituted biphenyl polyalkyl ester of formula I above.

Among other factors, the present invention is based on the surprising discovery that certain substituted biphenyl polyalkyl esters provide excellent control of engine deposits, especially on intake valves, when employed as fuel additives in fuel compositions.

DETAILED DESCRIPTION OF THE INVENTION

The substituted biphenyl polyalkyl esters of the present invention have the general formula:

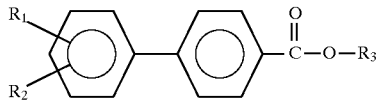

Formula I wherein $R_1$, $R_2$, $R_3$, and n are as defined above.

In formula I, $R_1$ is preferably hydrogen.

Preferably, $R_2$ is hydroxyl, amino, or aminomethyl. More preferably, $R_2$ is amino or aminomethyl. Most preferably, $R_2$ is an amino group.

Preferably, $R_3$ is a polyalkyl group having an average molecular weight in the range of about 500 to about 5,000, more preferably about 500 to about 3,000, and most preferably about 600 to about 2,000. It is especially preferred that $R_3$ have an average molecular weight of about 700 to about 1,500.

When $R_2$ is an N-alkylamino or N-alkylaminomethyl group, the alkyl group of the N-alkylamino or N-alkylaminomethyl moiety preferably contains 1 to about 4 carbon atoms. More preferably, the alkyl group is methyl or ethyl. For example, particularly preferred groups are N-methylamino, N-ethylamino, N-methylaminomethyl, and N-ethylaminomethyl groups.

Further, when $R_2$ is an N,N-dialkylamino or N,N-dialkylaminomethyl group, each alkyl group of the N,N-dialkylamino or N,N-dialkylaminomethyl moiety preferably contains 1 to about 4 carbon atoms. More preferably, each alkyl group is either methyl or ethyl. For example, particularly preferred groups are N,N-dimethylamino, N-ethyl-N-methylamino, N,N-diethylamino, N,N-dimethylaminomethyl, N-ethyl-N-methylaminomethyl, and N,N-diethylaminomethyl groups.

A preferred group of substituted biphenyl polyalkyl esters for use in this invention are compounds of formula I wherein $R_1$ is hydrogen or hydroxy; $R_2$ is hydroxy, amino, or aminomethyl; and $R_3$ is a polyalkyl group having an average molecular weight of about 500 to about 5,000.

A more preferred group of substituted biphenyl polyalkyl esters are those of formula I wherein $R_1$ is hydrogen; $R_2$ is amino or aminomethyl; and $R_3$ is a polyalkyl group having an average molecular weight of about 500 to about 3,000.

A particularly preferred group of substituted biphenyl polyalkyl esters are those of formula I wherein $R_1$ is hydrogen; $R_2$ is amino; and $R_3$ is a polyalkyl group having an average molecular weight of about 600 to about 2,000.

It is especially preferred that the hydroxyl, amino, aminomethyl, N-alkylamino, N-alkylaminomethyl, N,N-dialkylamino, or N,N-dialkylaminomethyl substituent, $R_2$, present in the aromatic moiety of the substituted biphenyl polyalkyl esters of this invention be situated in a meta or para position relative to the adjoining phenyl substituent. When the aromatic moiety also contains a hydroxyl group as the $R_1$ substituent, it is particularly preferred that this hydroxyl group be in a meta or para position relative to the phenyl substituent and in an ortho position relative to the $R_2$ hydroxyl, aminomethyl, N-alkylamino, N-alkylaminomethyl, N,N-dialkylamino, or N,N-dialkylaminomethyl substituent.

The substituted biphenyl polyalkyl esters of the present invention will generally have a sufficient molecular weight so as to be non-volatile at normal engine intake valve operating temperatures (about 200° C. to about 250° C.). Typically, the molecular weight of the substituted biphenyl polyalkyl esters will range from about 600 to about 10,000, preferably from about 1,000 to about 3,000.

Fuel-soluble salts of the substituted biphenyl polyalkyl esters of the present invention can be readily prepared for those compounds containing an amino, aminomethyl, N-alkylamino, N-alkylaminomethyl, N,N-dialkylamino, or N,N-dialkylaminomethyl group and such salts are contemplated to be useful for preventing or controlling engine deposits. Suitable salts include, for example, those obtained by protonating the amino moiety with a strong organic acid, such as an alkyl- or aryl-sulfonic acid. Preferred salts are derived from toluene sulfonic acid and methanesulfonic acid.

Fuel-soluble salts of the substituted biphenyl polyalkyl esters of the present invention can also be readily prepared for those compounds containing a hydroxyl group. Such salts include alkali metal, alkaline earth metal, ammonium, substituted ammonium, and sulfonium salts. Perferred metal salts are the alkaline metal salts, particularly, the sodium and potassium salts, and the substituted ammonium salts, particularly, tetraalkyl-substituted ammonium salts, such as the tetrabutylammonium salts.

Definitions

As used herein, the following terms have the following meanings unless expressly stated to the contrary.

The term "amino" refers to the group: —$NH_2$.

The term "aminomethyl" refers to the group: —$CH_2NH_2$.

The term "cyano" refers to the group: —CN.

The term "nitro" refers to the group: —$NO_2$.

The term "N-alkylamino" refers to the group: —$NHR_a$ wherein $R_a$ is an alkyl group.

The term "N,N-dialkylamino" refers to the group: —$NR_bR_c$ wherein $R_b$ and $R_c$ are alkyl groups.

The term "N-alkylaminomethyl" refers to the group: —$CH_2NHR_d$ wherein $R_d$ is an alkyl group. The term "N,N-dialkylaminomethyl" refers to the group: —$CH_2NR_eR_f$ wherein $R_e$ and $R_f$ are alkyl groups.

The term "alkyl" refers to both straight- and branched-chain alkyl groups.

The term "lower alkyl" refers to alkyl groups having 1 to about 6 carbon atoms and includes primary, secondary, and tertiary alkyl groups. Typical lower alkyl groups include, for example, methyl, ethyl, n-propyl, isopropyl, n-butyl, sec-butyl, t-butyl, n-pentyl, n-hexyl, and the like.

The term "polyalkyl" refers to an alkyl group which is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The term "lower alkoxy" refers to the group —$OR_g$ wherein $R_g$ is lower alkyl. Typical lower alkoxy groups include methoxy, ethoxy, and the like.

The term "fuel" or "hydrocarbon fuel" refers to normally liquid hydrocarbons having boiling points in the range of gasoline and diesel fuels.

General Synthetic Procedures

The substituted biphenyl polyalkyl esters of this invention can be prepared by the following general methods and procedures. Those skilled in the art will recognize that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but one skilled in the art will be able to determine such conditions by routine optimization procedures.

Moreover, those skilled in the art will recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, *Protective Groups in Organic Synthesis*, Second Edition, Wiley, N.Y., 1991, and references cited therein.

In the present synthetic procedures, a hydroxyl group will preferably be protected, when necessary, as the benzyl or tert-butyldimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the substituted biphenyl polyalkyl esters of this invention having an amino group on the aromatic moiety will generally be prepared from the corresponding nitro derivative. Accordingly, in many of the following procedures, a nitro group will serve as a protecting group for the amino moiety. Moreover, the compounds of this invention having a —$CH_2NH_2$ group on the aromatic moiety will generally be prepared from the corresponding cyano derivative, —CN. Thus, in many of the following procedures, a cyano group will serve as a protecting group for the —$CH_2NH_2$ moiety.

The substituted biphenyl polyalkyl esters (Formula I) of the present invention may be prepared by esterifying a substituted biphenyl carboxylic acid having the formula:

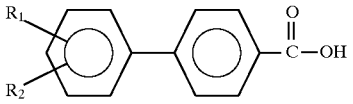

Formula II wherein $R_1$, and $R_2$ are as defined above, with a polyalkyl alcohol having the formula:

$R_3$—OH Formula III wherein $R_3$ is as defined above, using conventional esterification reaction conditions.

The substituted biphenyl carboxylic acids of formula II are either known compounds or can be prepared from known compounds by conventional procedures. Aromatic compounds suitable for use as starting materials in this invention include, for example, 4'-hydroxy-4-biphenylcarboxylic acid, available from Aldrich Chemical Company, 4'-nitro-4-biphenyl-carboxylic acid, as described in GB 1,059,350, and 4'-cyano-4-biphenylcarboxylic acid, as described in JP 54041852.

The polyalkyl alcohols of formula III may also be prepared by conventional procedures known in the art. Such procedures are taught, for example, in U.S. Pat. Nos. 5,055,607 to Buckley and 4,859,210 to Franz et al., the disclosures of which are incorporated herein by reference.

In general, the polyalkyl substituent on the polyalkyl alcohols of formula III and the resulting substituted biphenyl polyalkyl esters of the present invention will have an average molecular weight in the range of about 450 to about 5,000, preferably about 500 to about 5,000, more preferably about 500 to about 3,000, and most preferably about 600 to about 2,000.

The polyalkyl substituent on the polyalkyl alcohols employed in the invention may be generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl alcohols are polyisobutenes which comprise at least about 20% of the more reactive methylvinylidene isomer, preferably at least about 50% and more preferably at least about 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Such polyisobutenes, known as "reactive" polyisobutenes, yield high molecular weight alcohols in which the hydroxyl group is at or near the end of the hydrocarbon chain.

Examples of suitable polyisobutenes having a high alkylvinylidene content include Ultravis 30, a polyisobutene having a molecular weight of about 1,300 and a methylvinylidene content of about 74%, and Ultravis 10, a polyisobutene having a molecular weight of about 950 and a methylvinylidene content of about 76%, both available from British Petroleum.

The polyalkyl alcohols may be prepared from the corresponding olefins by conventional procedures. Such procedures include hydration of the double bond to give an alcohol. Suitable procedures for preparing such long-chain alcohols are described in I. T. Harrison and S. Harrison, *Compendium of Organic Synthetic Methods*, Wiley-Interscience, N.Y. (1971), pp. 119–122, as well as in U.S. Pat. Nos. 5,055,607 and 4,859,210.

As indicated above, the substituted biphenyl polyalkyl esters of formula I may be prepared by esterifying a substituted biphenyl carboxylic acid of formula II with a polyalkyl alcohol of formula III under conventional esterification reaction conditions.

Typically, this reaction will be conducted by contacting a polyalkyl alcohol of formula III with about 0.25 to about 1.5 molar equivalents of a substituted biphenyl carboxylic acid of formula II in the presence of an acidic catalyst at a temperature in the range of about 70° C. to about 160° C. for about 0.5 to about 48 hours. Suitable acid catalysts for this reaction include p-toluene sulfonic acid, methane sulfonic acid and the like. The reaction may be conducted in the presence or absence of an inert solvent, such as benzene, toluene, xylene and the like. The water generated by this reaction is preferably removed during the course of the reaction by, for example, azeotropic distillation with an inert solvent, such as toluene.

Alternatively, the substituted biphenyl polyalkyl aromatic esters of formula I may be prepared by reacting a polyalkyl alcohol of formula III with an acid halide derived from a substituted biphenyl carboxylic acid of formula II, such as an acid chloride or acid bromide.

Generally, the substituted biphenyl carboxylic acid moiety of formula II may be converted into an acyl halide moiety by contacting a compound of formula II with an inorganic acid halide, such as thionyl chloride, phosphorous trichloride, phosphorous tribromide, or phosphorous pentachloride; or with oxalylchloride. Typically, this reaction will be conducted using about 1 to about 5 molar equivalents of the inorganic acid halide or oxalyl chloride, either neat or in an inert solvent, such as diethyl ether, at a temperature in the range of about 20° C. to about 80° C. for 1 to about 48 hours. A catalyst, such as N,N-dimethylformamide, may also be used in this reaction.

Reaction of the acid halide derived from formula II with a polyalkyl alcohol of formula III provides a substituted biphenyl polyalkyl aromatic ester of formula I. Typically, this reaction is conducted by contacting formula III with about 0.9 to about 1.5 molar equivalents of the acid halide in an inert solvent, such as toluene, dichloromethane, diethyl ether, and the like, at a temperature in the range of about 25° C. to about 150° C. The reaction is generally complete in about 0.5 to about 48 hours. Preferably, the reaction is conducted in the presence of a sufficient amount of an amine capable of neutralizing the acid generated during the reaction, such as triethylamine, di(isopropyl)ethylamine, pyridine, or 4-dimethylaminopyridine.

When the substituted biphenyl carboxylic acid of formula II contains a hydroxyl group, for example, when one of $R_1$ or $R_2$ is hydroxyl, protection of the substituted biphenyl hydroxyl group may be accomplished using well-known procedures. The choice of a suitable protecting group for a particular hydroxy aromatic carboxylic acid will be apparent to those skilled in the art. Various protecting groups, and their introduction and removal, are described, for example, in T. W. Greene and P. G. M. Wuts, *Protective Groups in Organic Synthesis*, Second Edition, Wiley, N.Y., 1991, and references cited therein.

Deprotection of the aromatic hydroxyl group(s) can also be accomplished using conventional procedures. Appropriate conditions for this deprotection step will depend upon the protecting group(s) utilized in the synthesis and will be readily apparent to those skilled in the art. For example, benzyl protecting groups may be removed by hydrogenolysis under 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from 0° C. to about 40° C. for 1 to about 24 hours.

When synthesizing the substituted biphenyl polyalkyl esters of formula I having an amino or aminomethyl group on the aromatic moiety (i.e., where $R_2$ is an amino or aminomethyl group), it is generally desirable to first prepare the corresponding nitro or cyano compound (i.e., where $R_2$ is a nitro or cyano group) using the above-described synthetic procedures, and then to reduce the nitro or cyano group to an amino or aminomethyl group, respectively, using conventional procedures. Aromatic nitro or cyano groups may be reduced to amino or aminomethyl groups, respectively, using a number of procedures that are well known in the art. See, or example, the article entitled, "*Amination by Reduction*" in Kirk-Othmer "*Encyclopedia of Chemical Technology*", second Edition, Vol. 2, pp 76–99. Generally, such reductions can be carried out with, for example, hydrogen, carbon monoxide, or hydrazine, (or mixtures of the same) in the presence of metallic catalysts such as palladium, platinum, and its oxides, nickel, copper chromite, etc. Co-catalysts such as alkali or alkaline earth metal hydroxides or amines (including amino phenols) can be used in these catalyzed reductions.

Reductions can also be accomplished through the use of reducing metals in the presence of acids, such as hydrochloric acid. Typical reducing metals are zinc, iron, and tin; salts of these metals can also be used.

Typically, the amino or aminomethyl substituted biphenyl polyalkyl esters of the present invention are obtained by reduction of the corresponding nitro or cyano compound with hydrogen in the presence of a metallic catalyst such as palladium. This reduction is generally carried out at temperatures of about 20° C. to about 100° C., preferably, about 20° C. to about 40° C., and hydrogen pressures of about atmospheric to about 200 psig, typically, about 20 to about 80 psig. The reaction time for reduction usually varies between about 5 minutes to about 24 hours. Substantially, inert liquid diluents and solvents, such as ethanol, cyclohexane, ethyl acetate, toluene, etc, can be used to facilitate the reaction. The substituted biphenyl polyalkyl esters of the present invention can then be obtained by well-known techniques.

Fuel Compositions

The substituted biphenyl polyalkyl esters of the present invention are useful as additives in hydrocarbon fuels to prevent and control engine deposits, particularly intake valve deposits. Typically, the desired deposit control is achieved by operating an internal combustion engine with a fuel composition containing a substituted biphenyl polyalkyl ester of the present invention. The proper concentration of additive necessary to achieve the desired level of deposit control varies depending upon the type of fuel employed, the type of engine, and the presence of other fuel additives.

In general, the concentration of the substituted biphenyl polyalkyl esters of this invention in hydrocarbon fuel will range from about 50 to about 2,500 parts per million (ppm) by weight, preferably from about 75 to about 1,000 ppm. When other deposit control additives are present, a lesser amount of the present additive may be used.

The substituted biphenyl polyalkyl esters of the present invention may also be formulated as a concentrate using an inert stable oleophilic (i.e., dissolves in gasoline) organic solvent boiling in the range of about 150° F. to about 400° F. (about 65° C. to about 205° C.). Preferably, an aliphatic or an aromatic hydrocarbon solvent is used, such as benzene, toluene, xylene, or higher-boiling aromatics or aromatic thinners. Aliphatic alcohols containing about 3 to about 8 carbon atoms, such as isopropanol, isobutylcarbinol, n-butanol, and the like, in combination with hydrocarbon solvents are also suitable for use with the present additives. In the concentrate, the amount of the additive will generally range from about 10 to about 70 weight percent, preferably about 10 to about 50 weight percent, more preferably from about 20 to about 40 weight percent. In gasoline fuels, other fuel additives may be employed with the additives of the present invention, including, for example, oxygenates, such as t-butyl methyl ether, antiknock agents, such as methylcyclopentadienyl manganese tricarbonyl, and other dispersants/detergents, such as hydrocarbyl amines, hydrocarbyl poly(oxyalkylene) amines, or succinimides. Additionally, antioxidants, metal deactivators, and demulsifiers may be present.

In diesel fuels, other well-known additives can be employed, such as pour point depressants, flow improvers, cetane improvers, and the like.

A fuel-soluble, nonvolatile carrier fluid or oil may also be used with the substituted biphenyl polyalkyl esters of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Patent Application Nos. 356,726 and 382,159, published Mar. 7, 1990 and Aug. 16, 1990, respectively.

These carrier fluids are believed to act as a carrier for the fuel additives of the present invention and to assist in removing and retarding deposits. The carrier fluid may also exhibit synergistic deposit control properties when used in combination with a substituted biphenyl polyalkyl esters of this invention.

The carrier fluids are typically employed in amounts ranging from about 100 to about 5,000 ppm by weight of the hydrocarbon fuel, preferably from about 400 to about 3,000 ppm by weight of the fuel. Preferably, the ratio of carrier fluid to deposit control additive will range from about 0.5:1 to about 10:1, more preferably from 1:1 to about 4:1, most preferably about 2:1.

When employed in a fuel concentrate, carrier fluids will generally be present in amounts ranging from about 20 to about 60 weight percent, preferably from about 30 to about 50 weight percent.

EXAMPLES

The following examples are presented to illustrate specific embodiments of the present invention and synthetic preparations thereof; and therefore these examples should not be interpreted as limitations upon the scope of this invention.

Example 1

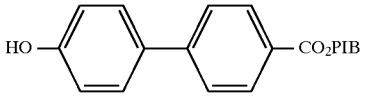

To a flask equipped with a magnetic stirrer, thermometer, Dean-Stark trap, reflux condensor and nitrogen inlet was added 7.8 grams of polyisobutanol (molecular weight average 984, prepared via hydroformylation of Amoco H-100 polyisobutene), 2.0 grams of 4'-hydroxy-4-biphenylcarboxylic acid and 0.13 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 7.1 grams of the desired product as a light yellow oil. $^1$H NMR ($CDCl_3$) d 8.1 (AB quartet, 2H), 7.6 (AB quartet, 2H), 7.5 (AB quartet, 2H), 6.95 (AB quartet, 2H), 5.1 (bs, 1H), 4.3 (t, 2H), 0.7–1.6 (m, 137H).

Example 2

Single-Cylinder Engine Test

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the value at the end of the run. The differences between the two weights is the weight of the deposit. A lesser amount of deposit indicates a superior additive. The operating conditions of the test were as follows: water jacket temperature 200° F.; vacuum of 12 in Hg, air-fuel ratio of 12, ignition spark timing of 400 BTC; engine speed is 1800 rpm; the crankcase oil is a commercial 30W oil.

The amount of carbonaceous deposit in milligrams on the intake valves is reported for each of the test compounds in Table I.

TABLE I

| | Intake Valve Deposit Weight (in milligrams) | | |
|---|---|---|---|
| Sample[1] | Run 1 | Run 2 | Average |
| Base Fuel | 328.0 | 319.5 | 323.8 |
| Example 1 | 154.4 | 235.3 | 194.9 |

[1]At 125 parts per million actives (ppma).

The base fuel employed in the above single-cylinder engine tests was a regular octane unleaded gasoline containing no fuel detergent. The test compounds were admixed with the base fuel to give the concentrations indicated in the tables.

The data in Table I illustrates the significant reduction in intake valve deposits provided by the substituted biphenyl polyalkyl esters of the present invention (Example 1) compared to the base fuel.

What is claimed is:

1. A compound of the formula:

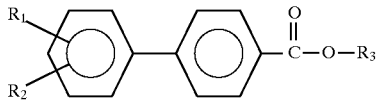

wherein:

$R_1$ is hydrogen or hydroxyl;

$R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

2. The compound according to claim 1, wherein $R_1$ is hydrogen and $R_2$ is amino or aminomethyl.

3. The compound according to claim 2, wherein $R_2$ is amino.

4. The compound according to claim 1, wherein $R_3$ is a polyalkyl group having an average molecular weight in the range of about 500 to about 5,000.

5. The compound according to claim 4, wherein $R_3$ has an average molecular weight in the range of about 500 to about 3,000.

6. The compound according to claim 5, wherein $R_3$ has an average molecular weight in the range of about 600 to about 2,000.

7. The compound according to claim 6, wherein $R_3$ is a polyalkyl group derived from polypropylene, polybutene, or polyalphaolefin oligomers of 1-octene or 1-decene.

8. The compound according to claim 7, wherein $R_3$ is derived from polyisobutene.

9. The compound according to claim 8, wherein the polyisobutene contains at least about 20% of a methylvinylidiene isomer.

10. A fuel composition comprising a major amount of hydrocarbons boiling in the gasoline or diesel range and an effective deposit-controlling amount of a compound of the formula:

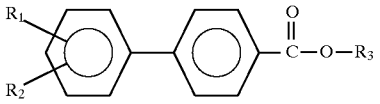

wherein:

$R_1$ is hydrogen or hydroxyl;

$R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range of about 450 to about 5,000.

11. The fuel composition according to claim 10, wherein $R_1$ is hydrogen and $R_2$ is amino or aminomethyl.

12. The fuel composition according to claim 11, wherein $R_2$ is amino.

13. The fuel composition according to claim 10, wherein $R_3$ is a polyalkyl group having an average molecular weight in the range of about 500 to about 5,000.

14. The fuel composition according to claim 13, wherein $R_3$ has an average molecular weight in the range of about 500 to about 3,000.

15. The fuel composition according to claim 14, wherein $R_3$ has an average molecular weight in the range of about 600 to about 2,000.

16. The fuel composition according to claim 15, wherein $R_3$ is a polyalkyl group derived from polypropylene, polybutene, or polyalphaolefin oligomers of 1-octene or 1-decene.

17. The fuel composition according to claim 16, wherein $R_3$ is derived from polyisobutene.

18. The fuel composition according to claim 17, wherein the polyisobutene contains at least about 20% of a methylvinylidiene isomer.

19. A method for reducing engine deposits in an internal combustion engine comprising operating an internal combustion engine with the fuel composition of claim 10.

20. A fuel concentrate comprising an inert stable oleophilic organic solvent boiling in the range of from about 150° F. to about 400° F. and from about 10 to about 70 weight percent of a compound of the formula

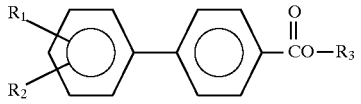

wherein:

$R_1$ is hydrogen or hydroxyl;

$R_2$ is hydroxyl, cyano, nitro, amino, aminomethyl, N-alkylamino or N-alkylaminomethyl wherein the alkyl group contains 1 to about 6 carbon atoms, N,N-dialkylamino or N,N-dialkylaminomethyl wherein each alkyl group independently contains 1 to about 6 carbon atoms, with the proviso that $R_1$ and $R_2$ are ortho relative to each other and meta or para relative to the adjoining phenyl substitutent; and $R_3$ is a polyalkyl group having an average molecular weight in the range bout 450 to about 5,000.

21. The fuel concentrate according to claim 20, wherein $R_1$ is hydrogen and $R_2$ is amino or aminomethyl.

22. The fuel concentrate according to claim 21, wherein $R_2$ is amino.

23. The fuel concentrate according to claim 20, wherein $R_3$ a polyalkyl group having an average molecular weight in the range of about 500 to about 6000.

24. The fuel concentrate according to claim 23, wherein $R_3$ is a polyalkyl group having an average molecular weight in the range of about 500 to about 3,000.

25. The fuel concentrate according to claim 24, wherein $R_3$ has an average molecular weight in the range of about 600 to about 2,000.

26. The fuel concentrate according to claim 25, wherein $R_3$ is a polyalkyl group derived from polypropylene, polybutene, or polyalphaolefin oligomers of 1-octene or 1-decene.

27. The fuel concentrate according to claim 26, wherein $R_3$ is derived from polyisobutene.

28. The fuel concentrate according to claim 27, wherein the polyisobutene contains at least about 20% of a methylvinylidiene isomer.

29. The fuel concentrate according to claim 20, wherein the fuel concentrate further contains from about 20 to about 60 weight percent of a fuel-soluble, nonvolatile carrier fluid.

* * * * *